US006102207A

United States Patent [19]

Carse

[11] Patent Number: 6,102,207

[45] Date of Patent: Aug. 15, 2000

[54] COLLECTABLE ARTICLE AUTHENTICATION SYSTEM

[75] Inventor: Paul D. Carse, Plainsboro, N.J.

[73] Assignee: Comics Guarantee Corporation, Parsippany, N.J.

[21] Appl. No.: 09/437,846

[22] Filed: Nov. 10, 1999

[51] Int. Cl.[7] ..... B65D 85/00

[52] U.S. Cl. ..... 206/459.1; 206/776; 206/1.5; 206/807

[58] Field of Search ..... 206/769, 770, 206/771, 775, 776, 782, 1.5, 807, 424, 459.1

[56] References Cited

U.S. PATENT DOCUMENTS

| | | | |
|---|---|---|---|
| 5,040,671 | 8/1991 | Hager | 206/776 X |
| 5,353,925 | 10/1994 | Lennen et al. . | |
| 5,415,290 | 5/1995 | Merkley et al. . | |
| 5,599,044 | 2/1997 | Lykens | 206/424 X |
| 5,727,684 | 3/1998 | Webb et al. | 206/459.1 X |

*Primary Examiner*—Jacob K. Ackun
*Attorney, Agent, or Firm*—Mathews, Collins, Shepherd & Gould, P.A.

[57] ABSTRACT

The present invention relates to a collectable article authentication system in which the collectable article is placed in a core. For example, the collectable article can be a comic book. Means for authenticating the collectable article is coupled to the core. The core is received in a cavity of a case. The cavity is formed between a top and bottom. The top and bottom are ultrasonically bonded together. The case is designed to include means for positively indicating sealing of the top to the bottom which means form a visible irreparable condition of the case indicative of tampering. Key slots are formed in the side of the case to allow a purchaser after purchasing the collectable article to insert a tool, such as a screw driver, in order to open the case. After the case is opened, the core layers can be peeled apart for allowing the purchaser to handle the collectable article. It will be appreciated that after the case has been opened, the collectable article is no longer certified as authentic.

28 Claims, 15 Drawing Sheets

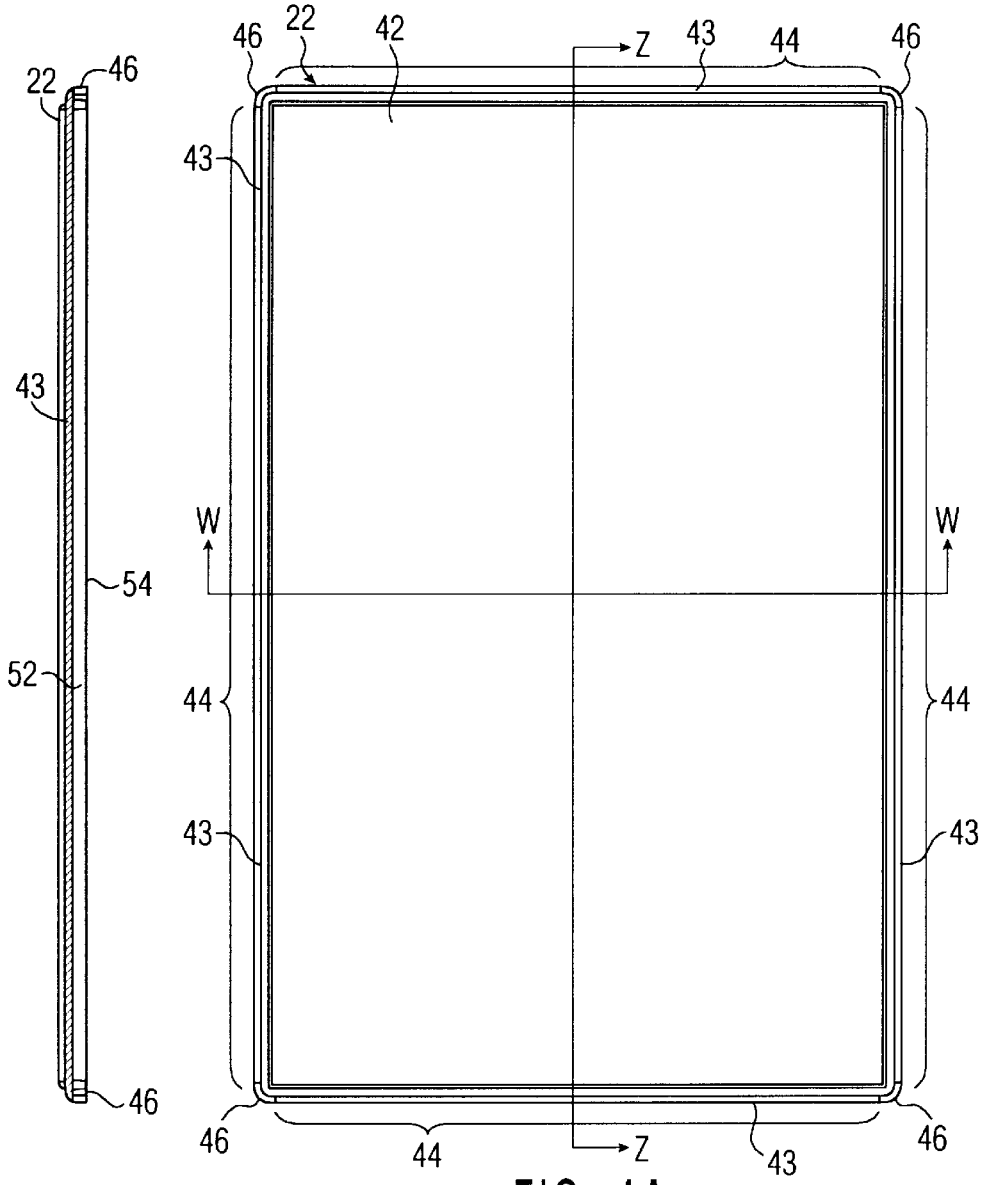
FIG. 4A
FIG. 4D
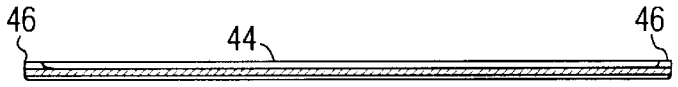
FIG. 4C

COLLECTABLE ARTICLE AUTHENTICATION SYSTEM

BACKGROUND OF THE INVENTION

1. Technical Field

The present invention relates to a collectable article authentication system, such as for a comic book, providing positive evidence of tampering with the article.

2. Description of the Related Art

Comic book protection systems are known. U.S. Pat. No. 5,415,290 describes a comic book protection cover system including an open ended bag formed of thin flexible transparent polypropylene and a rectangular rigid transparent insert. Space remains in the bag for receipt of the comic book adjacent the insert. The bag is releasably closed with long spreader fingers facing each other along the open end of the bag.

U.S. Pat. No. 5,353,925 describes a preservation device for a collectable article in which a front and back panel define a cavity for receiving the collectable article. A spacing sheet positioned between the front and back panels creates a channel around the article. A gaseous substance is circulated around the channel. The gaseous substance is exposed to a desiccant for removing moisture. Screws are used to secure the back panel to the front panel. The article can be removed from the preservation device by unscrewing the screws.

Comic books and other collectable items such as books, magazines, stamps and the like are sold at trade shows and collectable item dealer stores. In addition, collectable items are increasingly being transacted over the Internet. In these types of transactions, purchasers are concerned that the item purchased is not authentic. It is desirable to provide a collectable article holder for both preservation of the item and certification thereof The collectable article authentication also providing readily observable positive evidence if tampering of the holder has occurred, thereby indicating that the item contained in the holder is authentic.

SUMMARY OF THE INVENTION

The present invention relates to a collectable article authentication system in which the collectable article is placed in a core. For example, the collectable article can be a comic book. The core is formed of layers of a transparent material having barrier properties which are sealed around the collectable article, thereby providing preservation of the collectable article. Means for authenticating the collectable article is coupled to the core. For example, the collectable article can be certified by a qualified appraiser and a certificate of the certification is affixed to the core.

The core is received in a cavity of a case. The cavity is formed between a top and bottom. The top and bottom are ultrasonically bonded together. The case is designed to include means for positively indicating sealing of the top to the bottom which means form a visible irreparable condition of the case indicative of tampering. Preferably, the means for positively indicating sealing of the top to the bottom includes a post protruding from an inner surface of each corner of the bottom which is received in a post cavity protruding from an inner surface of each corner of the top. Transparent corner sections of the case provide view ports to allow the engaged posts to be viewed after sonically sealing of the case. Accordingly, when purchasing a certified collectable article the buyer can view the certificate to determine certification of the collectable article. Also, the buyer can view the core and posts to determine evidence of tampering with the case.

Viewing sections are positioned along the side of the top and bottom portions of the case to allow a buyer to observe the side of the collectable article, such as the spine of the comic book, while the collectable article is sealed in the case. Key slots are formed in the side of the case to allow a purchaser after purchasing the collectable article to insert a tool, such as a screw driver, in order to open the case. After the case is opened, the core layers can be peeled apart for allowing the purchaser to handle the collectable article. It will be appreciated that after the case has been opened, or the core has been separated the collectable article is no longer certified as authentic.

The invention will be more fully described by reference to the following drawings.

BRIEF DESCRIPTION

FIG. 4A is a top plan view of the top of the case.

FIG. 4C is a vertical cross section of the top along line W—W of FIG. 4A.

FIG. 4D is a vertical cross section of the top along line Z—Z of FIG. 4A.

DETAILED DESCRIPTION

Figure 1A:
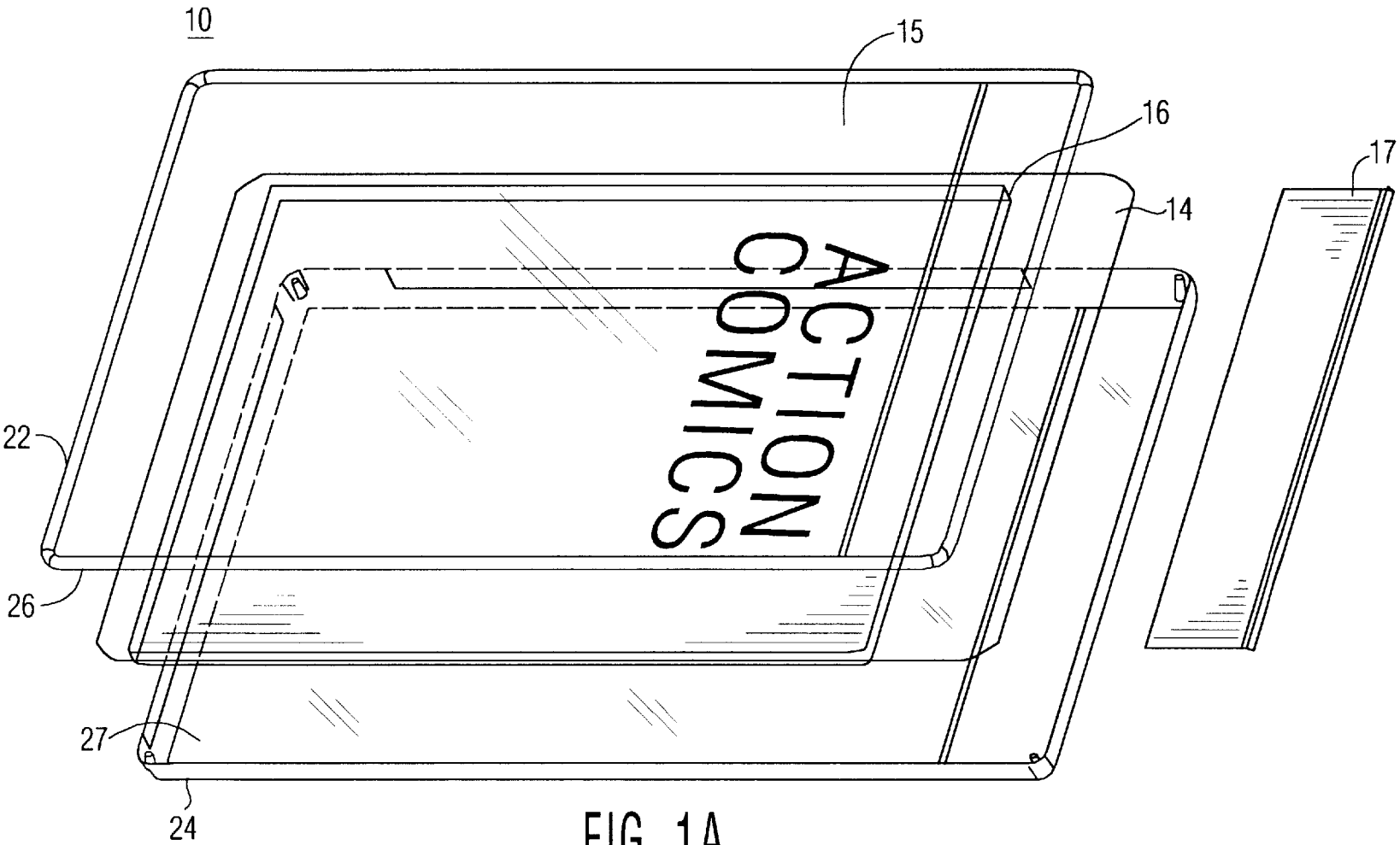
FIG. 1A is a perspective view of a collectable article authentication system in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 1B:
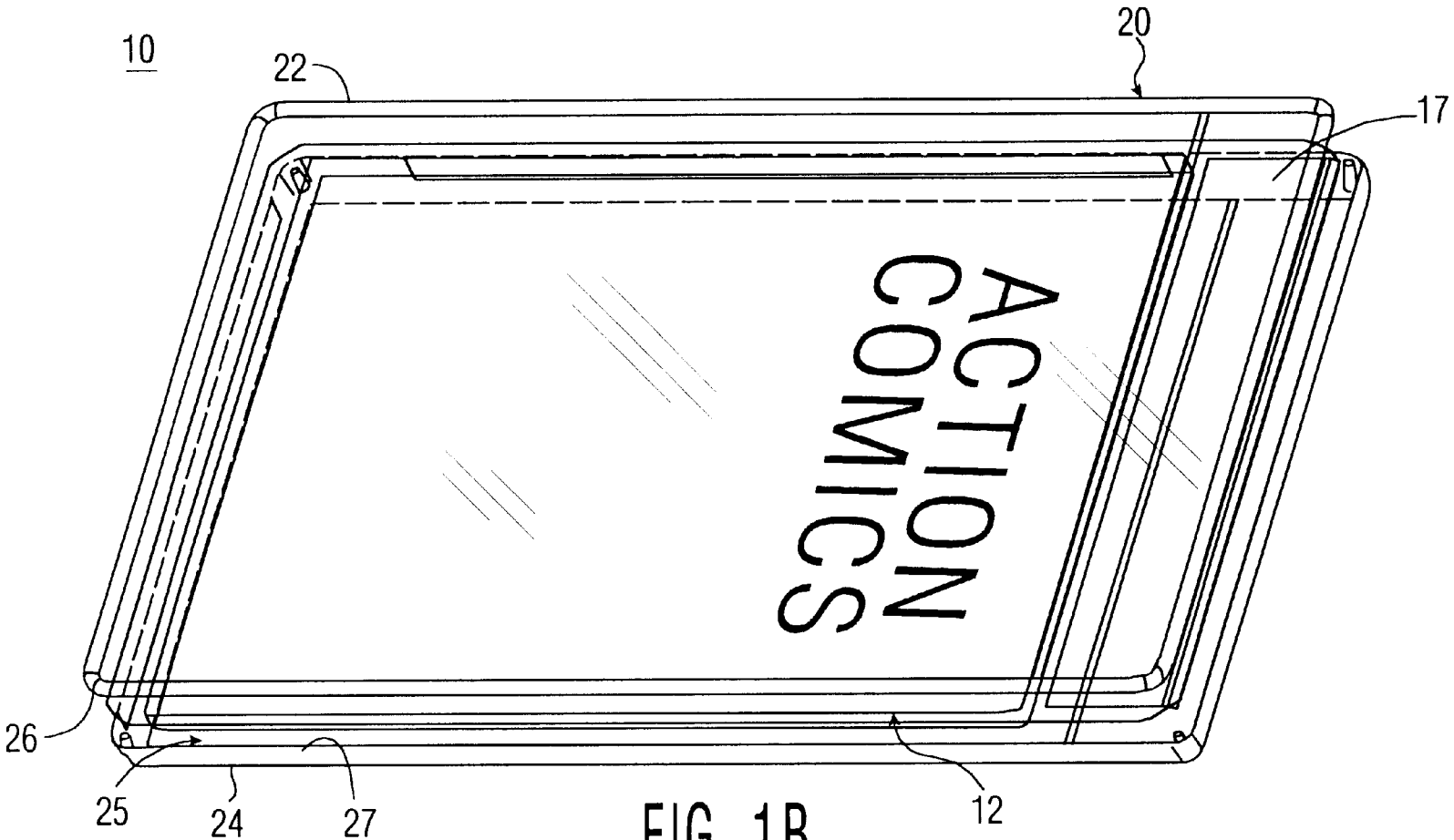
FIG. 1B is a perspective view of assembly of the collectable article authentication system.

FIGS. 1A and 1B illustrate perspective views of collectable article authentication system 10 in accordance with the teachings of the present invention. Core 12 is formed of first tray member 14 and second tray member 16. First tray member 14 and second tray member 16 are welded to each other around an inserted collectable article 15. For example, collectable article 15 can be a comic book, magazine or stamp. Certificate 17 is affixed to core 12. First tray member 14 and second tray member 16 are formed of an appropriate size to accommodate collectable article 15 and certificate 17. First tray member 14 and second tray member 16 are formed of a transparent plastic material having barrier properties for preventing air and moisture from communicating with collectable article 15. The transparent plastic material can be semi-rigid, thereby having some flexibility. The transparent material allows collectable article 15 sealed within core 12 to be readily observable. For example, first tray member 14 and second tray member 16 can be formed of polyester, polyethylene, polypropylene, polyterphthalate, Barex manufactured by BP Amoco, PETG, and Aclar manufactured by Allied Signal.

Case 20 is formed of top 22 and bottom 24. Cavity 25 is formed within inner wall 26 of top 22 and inner wall 27 of bottom 24 after top 22 is attached to bottom 24. Top 22 and bottom 24 are formed of an appropriate size for receiving core 12 within cavity 25. Top 22 and bottom 24 can be formed of a plastic material. Suitable materials for top 22 and bottom 24 include polystyrene, polyvinyl chloride, polyester, polycarbonate, polypropylene or polyethylene.

Top 22 and bottom 24 are interlocked together, thereby providing a permanent seal around core 12, as described in more detail below. Preferably, ultrasonic bonding is used to permanently seal top 22 to bottom 24, thereby enclosing core 12 within case 20. The procedure of ultrasonically bonding or welding plastic material is well known in the art and may be realized in any matter deemed appropriate for the practice of the invention disclosed herein.

Figure 2B:
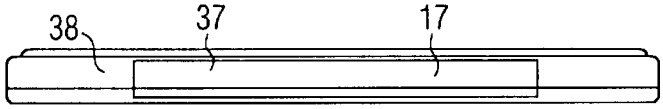
FIG. 2B is a side elevational view of the top side of the first layer.
Figure 2A:
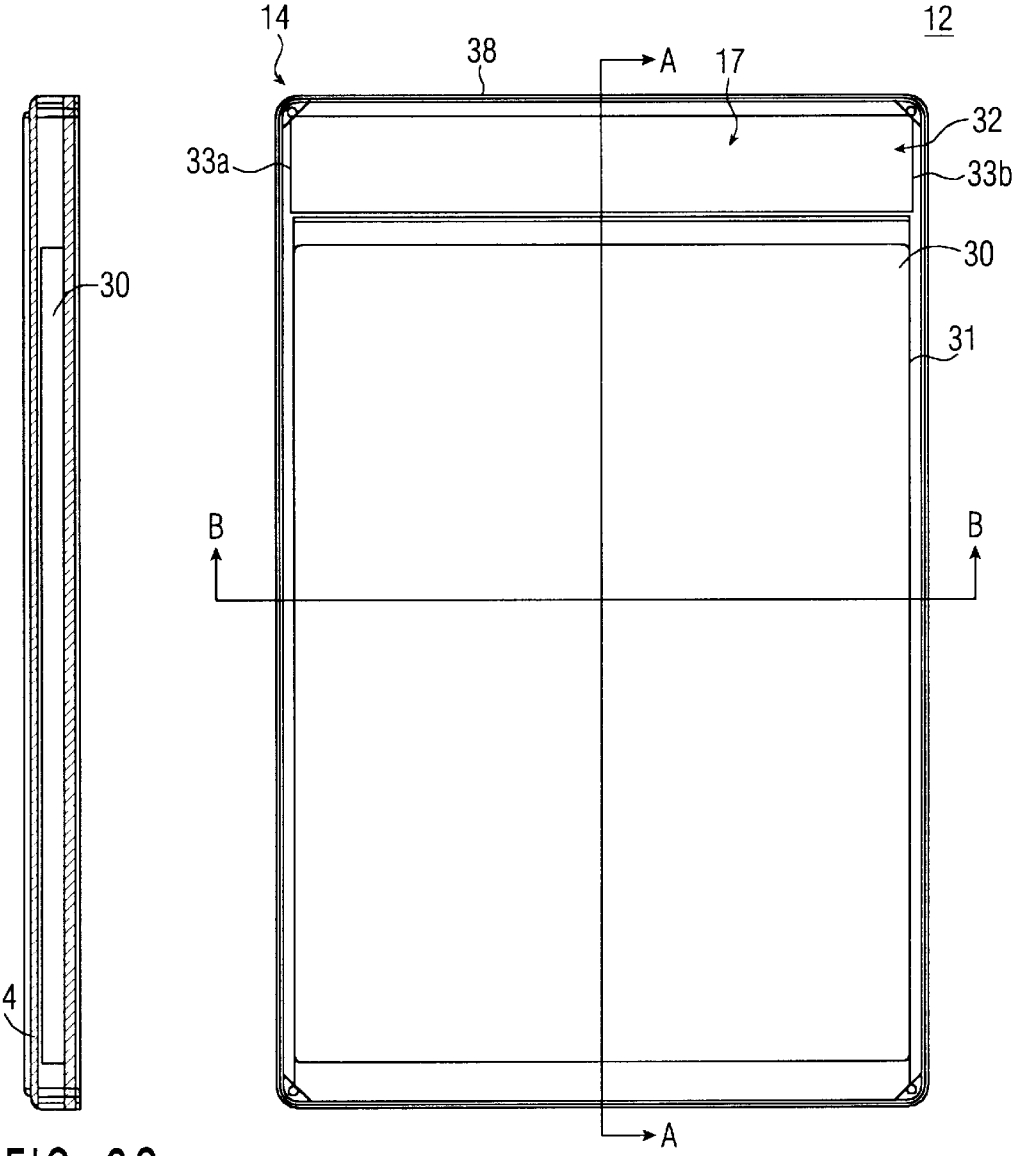
FIG. 2A is a top plan view of a first tray member of a core for the collectable article authentication system.
Figure 2C:
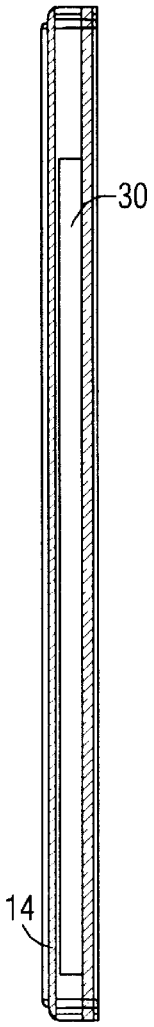
FIG. 2C is a vertical cross section along line A—A shown in FIG. 2A.
Figure 2D:
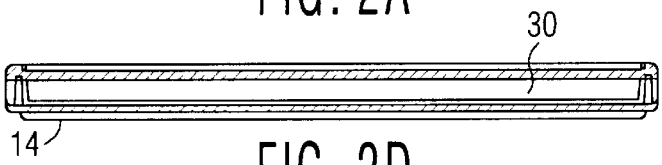
FIG. 2D is a vertical cross section along line B—B shown in FIG. 2A.
Figure 2E:
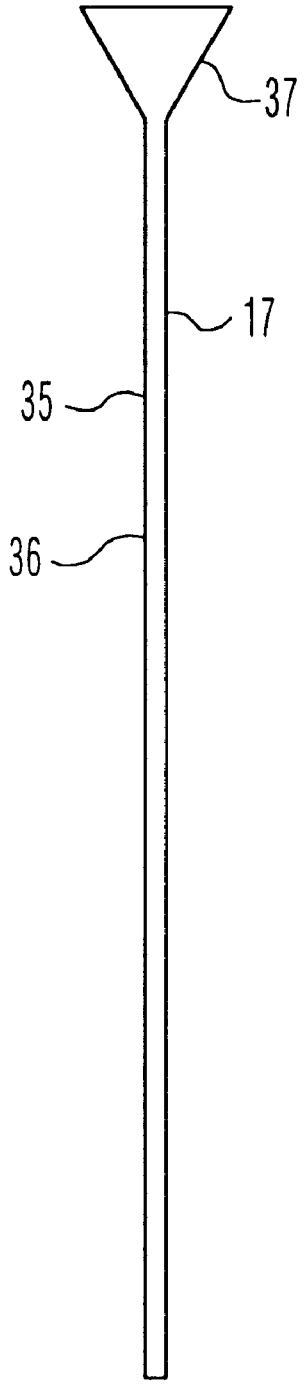
FIG. 2E is a side elevational view of a certificate label adapted to be affixed to the core.
Figure 3C:
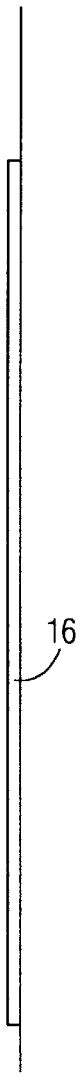
FIG. 3C is a vertical cross section along line Z—Z of FIG. 3A.
Figure 3A:
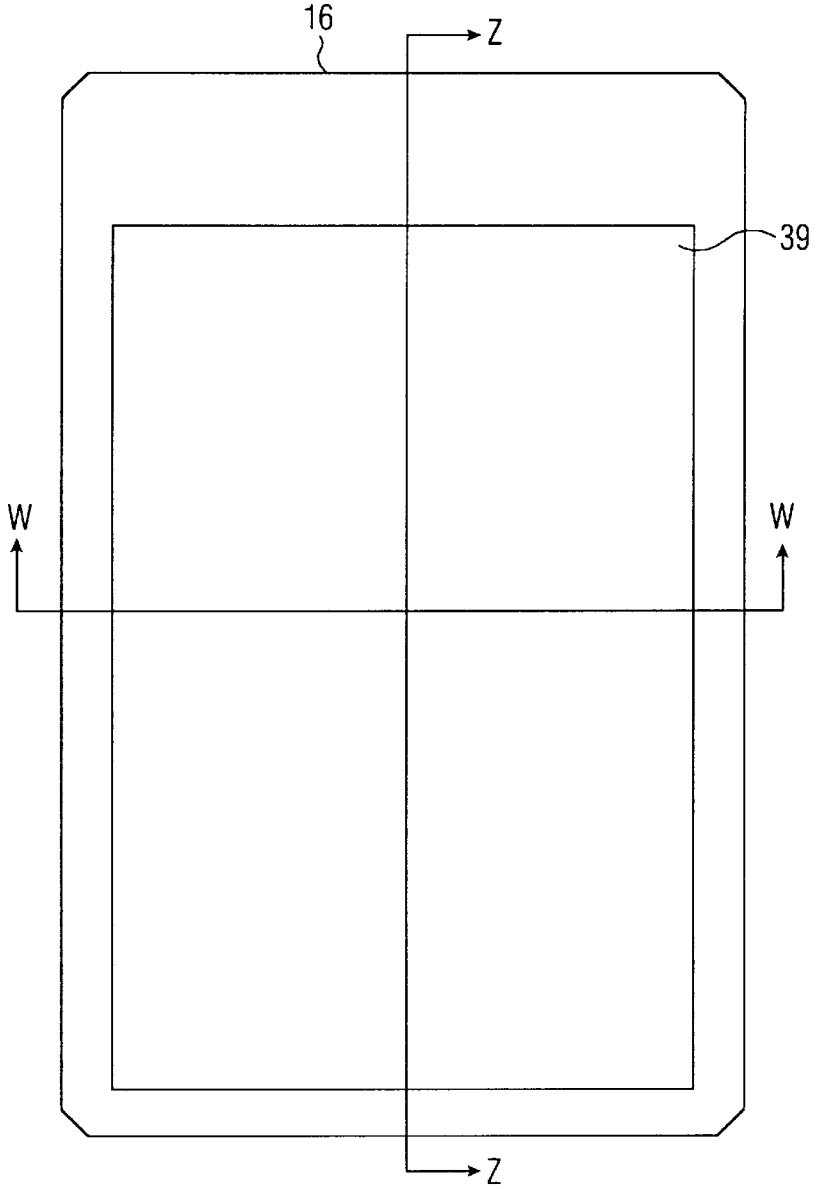
FIG. 3A is a top plan view of second tray member of the core.
Figure 3B:
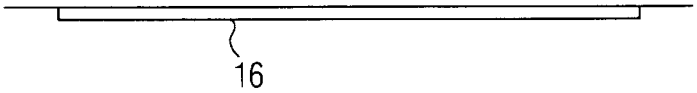
FIG. 3B is a vertical cross section along line W—W of FIG. 3A.

FIGS. 2A–2D and FIGS. 3A–3C illustrate detailed views of core 12. First tray member 14 includes depression 30. Preferably depression 30 is the approximate size of the collectable article for securely holding the collectable article within first tray member 14. Edge 31 of first tray member 14 adjacent the perimeter of depression 30 is sealed to second tray member 16. Authentication section 32 receives certificate 17. An example of certificate 17 is shown in FIG. 2E. Edge 33*a* and edge 33*b* can be sealed to second tray member 16, thereby forming an opening at edge 38 between first tray member 14 and second tray member 16. Certificate 17 can be received in the opening at edge 38 between first tray member 14 and second tray member 16. Certificate 17 can include certification indicia representing an indicator of the collectable article identity and quality, such as by the Certified Collectibles Group system of comic book evaluation. Certificate 17 can include pressure adhesive strips 35 on bottom surface 36 for affixing certificate 17 as a label to authentication section 32. Certificate 17 can include side 37 for wrapping around edge 38 of first tray member 14.

Second tray member 16 is formed of a flat sheet of material having the same shape as first tray member 14. Sheet 39 formed of a desiccant material can be placed between first tray member 14 and second tray member 16 before the tray members are sealed around the collectable article. Sheet 39 absorbs moisture which may be present within first tray member 14 and second tray member 16 before sealing. Sheet 39 can also be formed, of an anti-corrosive material to absorb, for example $H_2S$, $SO_2$, COS and $SO_2$ that may pass through first tray member 14 and second tray member 16. For example sheet 39 can be formed of a material such as Zeovate manufactured by BFF Nonwovens, England.

Figures 4B, 4E:
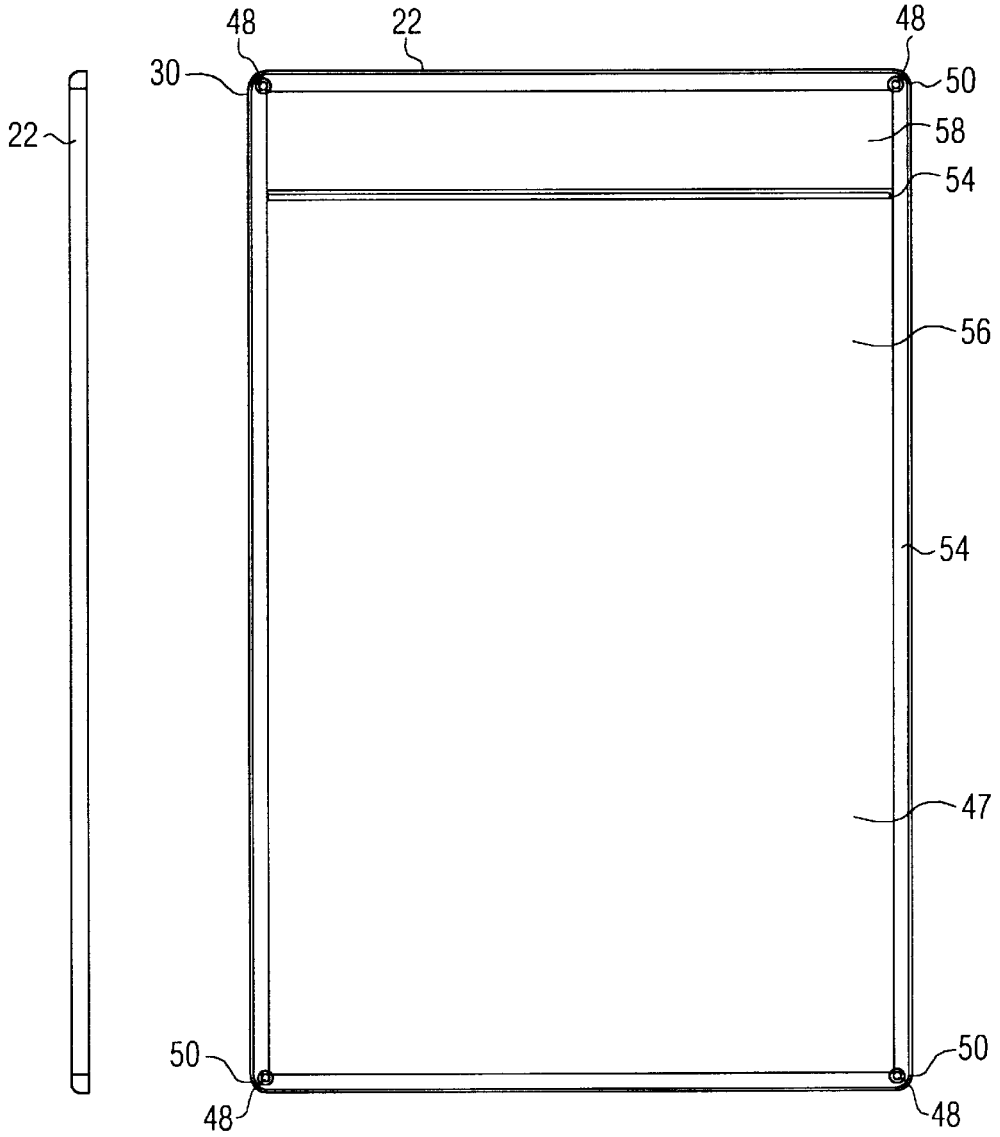
FIG. 4B is a bottom plan view of the top of the case.
FIG. 4E is a side elevational view of the top.

FIGS. 4A–4G are detailed views of top 22 of case 20. As shown in FIG. 4A, outer surface 42 is depressed from sides 43. Outer surface 42 is formed of a transparent material. Sides 43 include side section 44 formed of a material having a surface matte or texture which renders them at least partially opaque to provide a frosted appearance. Corner sections 46 of sides 43 are formed of a transparent material for allowing inserted posts to be observable in top 22, as described in more detail below.

Figure 4F:
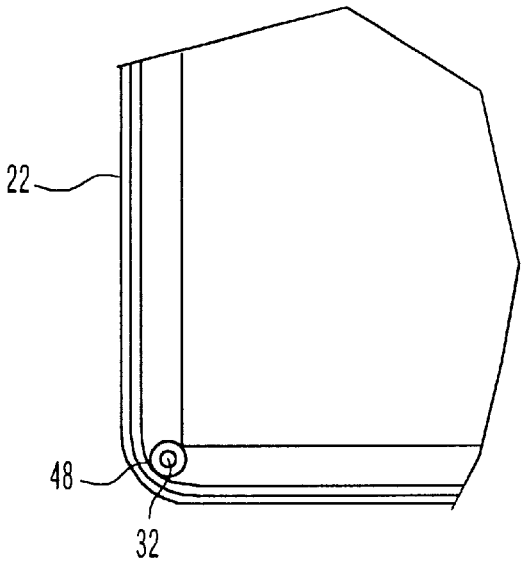
FIG. 4F is a detailed perspective view of a corner section of the top.
Figure 4G:
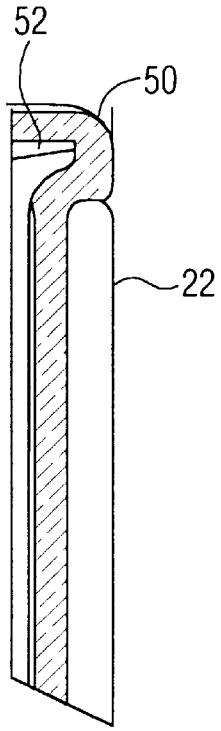
FIG. 4G is a detailed vertical cross section of the corner section of the top.
Figure 5A:
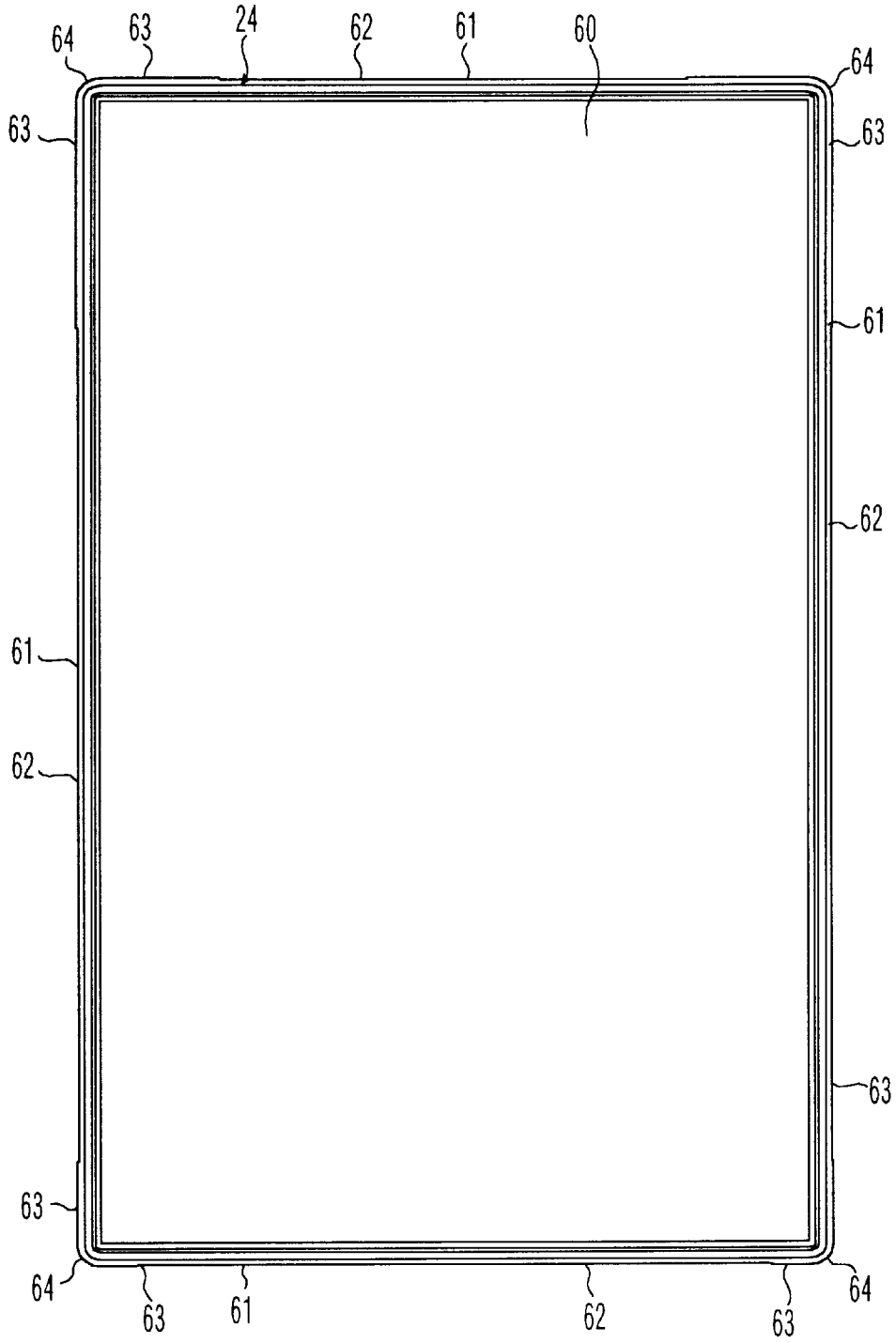
FIG. 5A is a top plan view of the bottom of the case.
Figure 5D:
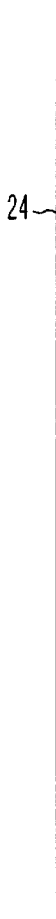
FIG. 5D is a vertical cross section of the bottom along section Z—Z of FIG. 5A.
Figure 5B:
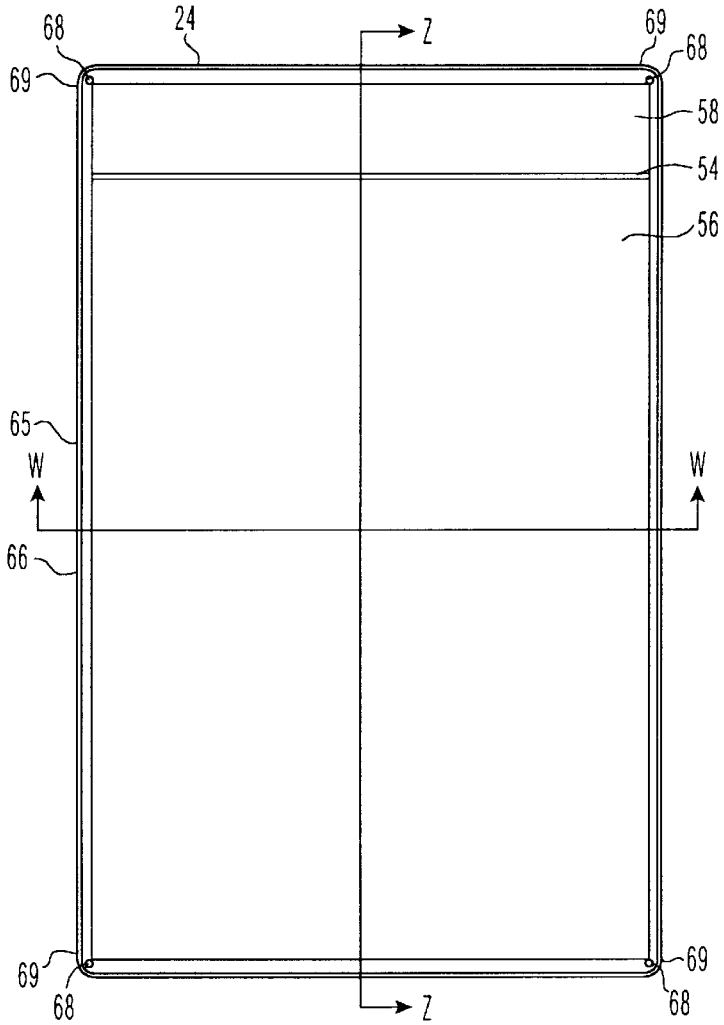
FIG. 5B is a bottom plan view of the bottom of the case.
Figure 5E:
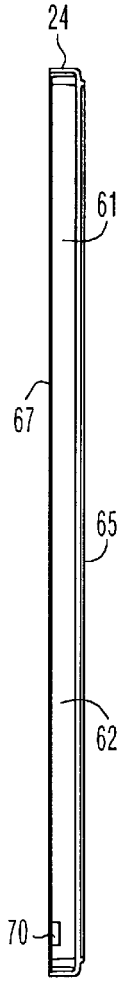
FIG. 5E is a side elevational view of the bottom.
Figure 5C:
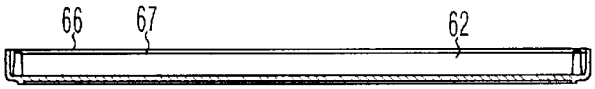
FIG. 5C is a vertical cross section of the bottom along section W—W of FIG. 5A.
Figure 5F:
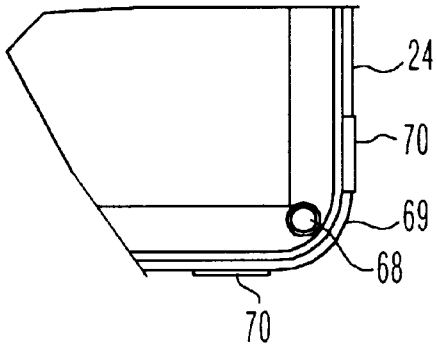
FIG. 5F is a detailed perspective view of a corner section of the bottom.
Figure 5G:
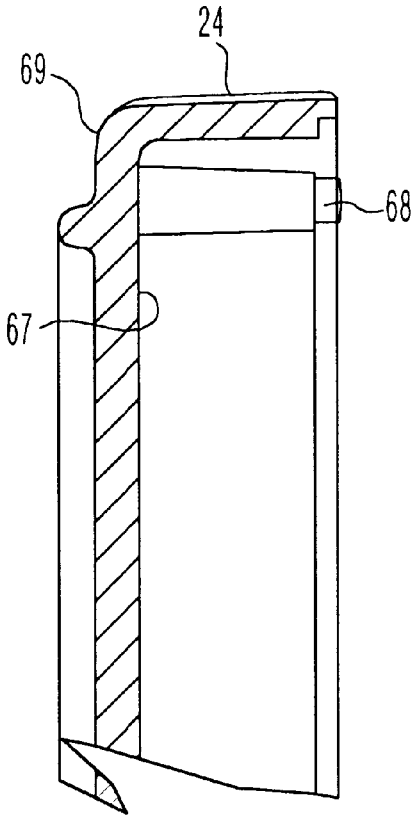
FIG. 5G is a detailed vertical cross section of the corner section of the bottom.

Protrusions 48 extend from inner surface 47 of at least one corner 50 and preferably each corner 50, as shown in FIG. 4B. Protrusions 48 have a tubular shape with post cavity 52 formed therein, as shown in FIGS. 4F and 4G. Preferably, protrusions 48 are formed integrally with top 22 of a transparent material. Post cavity 52 has a shape appropriate for receiving a post, as described below. Groove 53 is formed in bottom surface 54 of sides 43, as shown in FIG. 4E.

Ridge 54 is formed in inner surface 47 of top 22. Ridge 54 separates collectable viewing section 56 from authentication view section 58. Upon placement of the collectable article in case 20, the collectable article is viewable in collectable viewing section 56 and certificate 17 is viewable in authentication viewing section 58.

FIGS. 5A–5G are detailed views of bottom 24 of case 20. Top surface 60 is formed of a transparent material. Sides 61 extends from top surface 60. Sides 61 have a height which is greater than the height of core 12. Viewing section 62 can be formed in sides 61. Viewing section 62 is transparent. Section 63 of side 61 adjacent each corner 64 is formed of a material having a surface matte or texture which renders them at least partially opaque to provide a frosted appearance. Comer 64 of side 61 is formed of a transparent material. Section 63 enables an observers attention to be directed to corner 64. Flange 65 extends around the circumference of edge 66 of side 61.

Inside surface 67 of top 22 includes post 68 protruding from inner surface 67 at least one corner 69 and preferably each of the four corners of case 20. Preferably, each post 68 is formed integrally with bottom 24 of a transparent material. It will be appreciated that at least one post can protrude from the top and at least one post can be received in a post cavity of a protrusion protruding from the bottom in accordance with the teachings of the present invention. Depressions 70 are formed in sides 61.

Figure 6A:
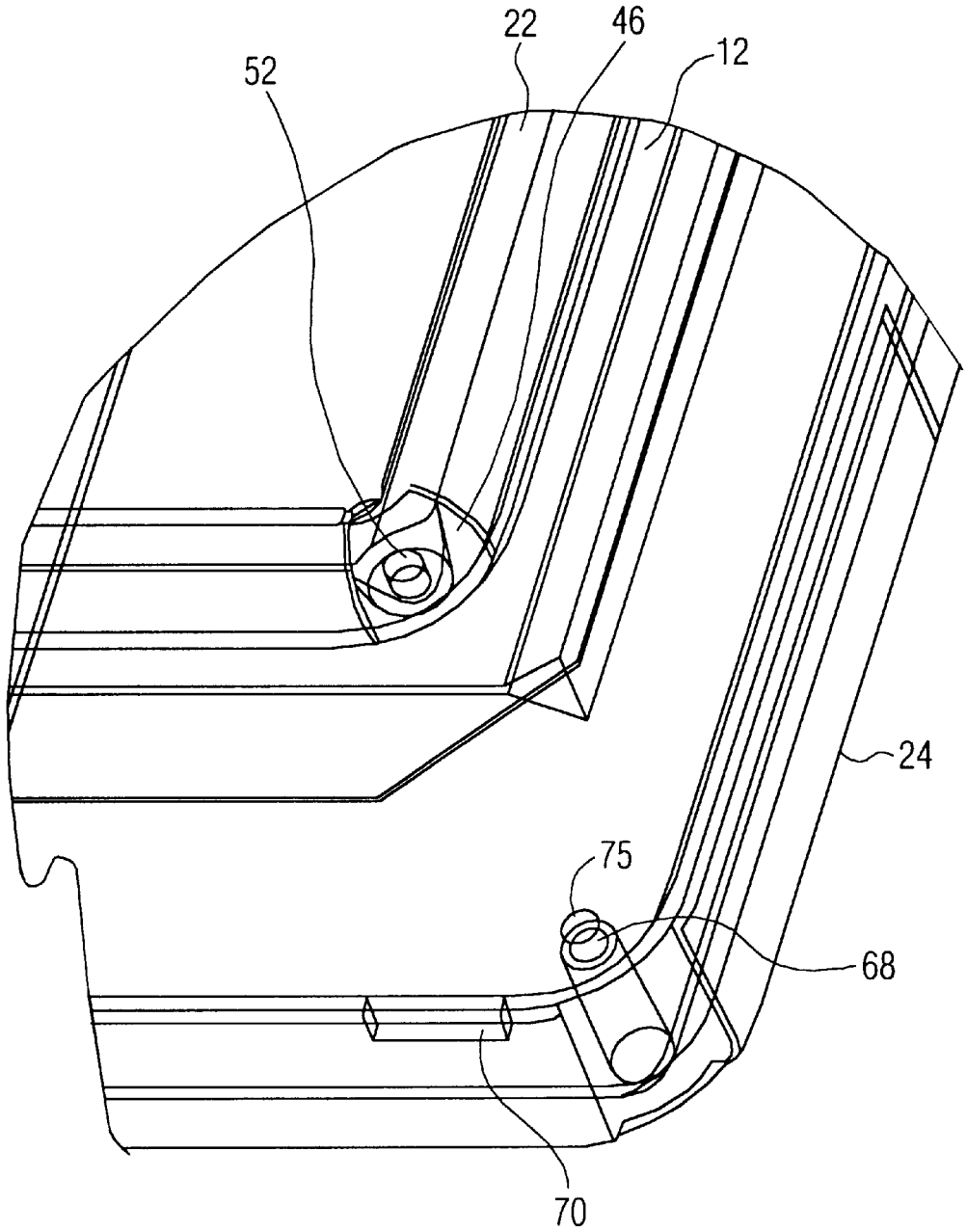
FIG. 6A is a detailed perspective view of a corner section of a top and bottom of a case in the collectable article authentication system.
Figure 6B:
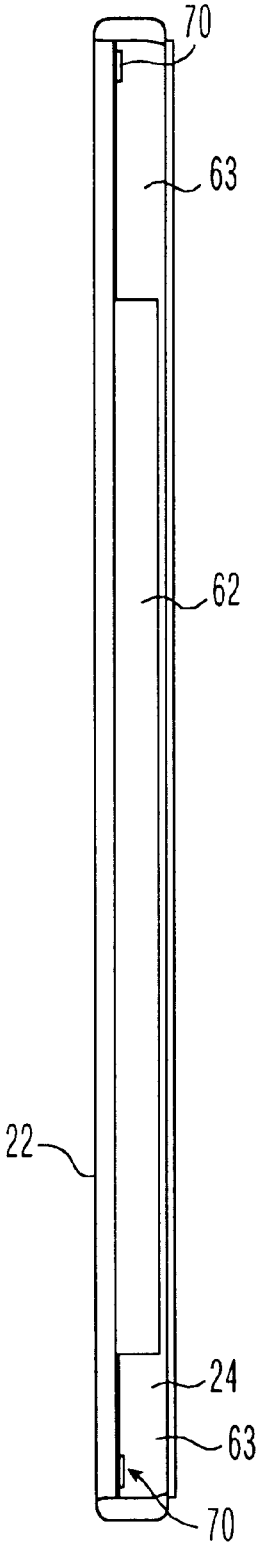
FIG. 6B is a side elevational view of the case with the top and bottom engaged.
Figure 6C:
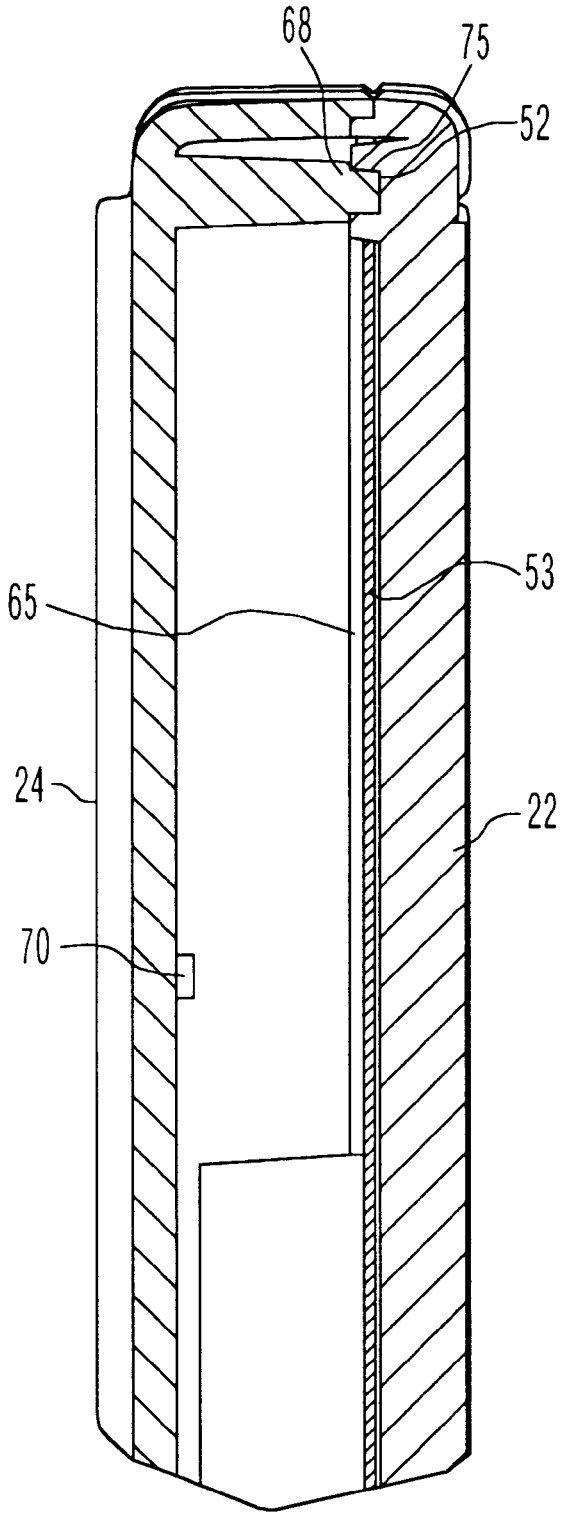
FIG. 6C is a detailed vertical cross section of a corner of FIG. 6B.

FIGS. 6A–6C illustrate engagement of top 22 and bottom 24 of case 20 after receiving core 12. Each post 68 engages a post cavity 52 of top 22 for interlocking bottom 24 to top 22 before ultra sonic bonding. Post 68 is the same or slightly larger diameter than post cavity 52 to enable post 68 to snap into post cavity 52 upon application of slight pressure. Post 68 can include energy director 75 for aiding forcing of post 68 into post cavity 52. During ultrasonic bonding, post 68 is welded to post cavity 52. Post 68 is observable as intact within post cavity 52. Post 68 engaged in post cavity 52 is observable through corner section 46 of top 22. Flange 65 of bottom 24 engages groove 53 of top 24. Viewing section 62 is placed adjacent the binding of the collectable article to allow the condition of the side of the collectable article to be observable within case 20. For example, if the collectable article is a comic book the spine of the collectable article is viewable in viewing section 62. A tool can be inserted within depressions 70 to pry a sealed top 22 from bottom 24. After breaking of the seal between top 22 and bottom 24, post 68 are visibly compromised for example as having a fracture resulting in post 68 no longer being observed as transparent. The compromised condition of post 68 indicates the positive seal between top 22 and bottom 24 has been broken, thereby indicating tampering of case 22. Also, if core 12 is removed from case 20 and core 12 has a tear or compromised condition there is an indication of tampering of core 12. It will be appreciated that after case 20 is opened or core 12 is compromised, the collectable article is no longer certified as authentic.

Figure 7:
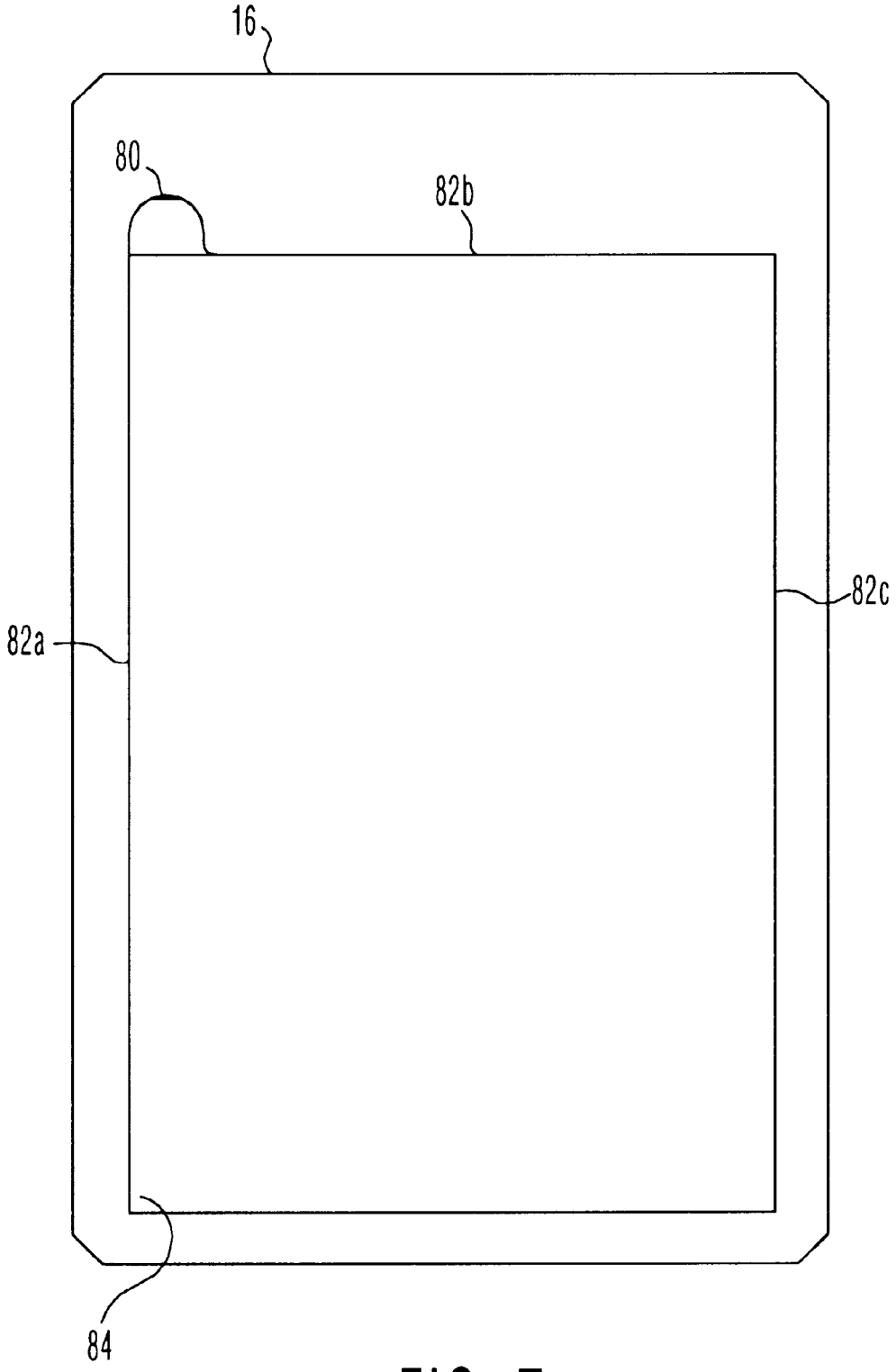
FIG. 7 is an alternate embodiment of the first tray member of the core.

FIG. 7 illustrates an alternative embodiment of second tray member 16. Second tray member 16 includes pull tab 80 to be pulled for releasing the seal between second tray member 16 and edge 31 of first tray member 14. Edges 82*a*, 82*b* and 82*c* can be perforated for allowing section 84 to be pulled away first tray member 14 for allowing the collectable article to be removed from depression 30 of first tray member 14.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

I claim:

1. A collectable article authentication system comprising:

a core adapted for receiving said collectable article;

means for authenticating said collectable article being attached to said core;

a case having a top and a bottom, said case defining a cavity between said top and bottom for receiving said core, said case being formed by ultrasonically welding said top and bottom together; and means for positively indicating sealing of said top to said bottom, wherein tampering with said case forms a visible irreparable condition of said case indicative of tampering.

2. The system of claim 1 wherein said core comprises:

a first tray member formed of a transparent material having barrier properties; and a second tray member formed of a transparent material having barrier properties, said first tray member and said second tray member being sealed together around the received collectable article for preservation of said collectable article.

3. The system of claim 2 wherein said first tray member and said second member are formed of polyester, polyethylene, polypropylene or polyterphthalate.

4. The system of claim 2 wherein said first tray member and said second tray member are semi-rigid.

5. The system of claim 2 wherein said first tray member includes a depression of a size approximately the same as the size of said collectable article.

6. The system of claim 5 wherein an edge of said first tray member adjacent said depression is sealed to second tray member, and a tear in said first tray number, said second tray number or said seal indicates tampering.

7. The system of claim 2 wherein said means for authenticating said collectable article comprises:

an authentification section between a bottom surface of said second tray member and a top surface of said first tray member.

8. The system of claim 7 wherein said authentication section is formed by sealing longitudinal edges of said first tray member on either side of said authentic section and a lateral edge forming an opening between said first tray member and said second tray member adapted to receive a certificate.

9. The system of claim 7 wherein said means for authenticating said collectable article comprises:

a certificate affixed with an adhesive to said top surface of said first tray member.

10. The system of claim 9 wherein said certificate is affixed with a pressure sensitive adhesive on bottom surface of said certificate and a top surface of said certificate includes certification indicia.

11. The system of claim 2 wherein said core further comprises a desiccant material or anti-corrosive material placed between said first tray member and said second tray member before said first tray member is sealed to said second tray member.

12. The system of claim 1 wherein said top and said bottom of said case are formed of plastic.

13. The system of claim 1 wherein said top and bottom of said case are formed of a rigid material.

14. The system of claim 1 wherein said top and bottom of said case are formed of polystyrene, polyvinyl chloride, polyester, polycarbonate or polyethylene.

15. The system of claim 1 wherein said means for positively indicating sealing of said top to said bottom comprises:

at least one protrusion extending from an inner surface of at least one corner of said top of said case, a post cavity formed within said protrusion; and a post extending from an inner surface of said bottom of said case, wherein said post is received in said post cavity before said top and bottom are sealed together and said post is welded to said post cavity during said ultrasonically welding said top and bottom together.

16. The system of claim 1 wherein an outer surface of said top is depressed from sides of said top, said outer surface being formed of a transparent material.

17. The system of claim 16 wherein said sides of said top are formed of a first section which is semi-opaque and at least one corner section which is transparent positioned between said first section of adjacent sides and said post and said protrusion are formed of a transparent material, wherein said post welded to said cavity is observable through said corner section and a fracture in said post indicates a tamper condition.

18. The system of claim 17 wherein said side of said top includes a groove and said side of said bottom includes a flange, said flange engaging said groove before said cage is formed by ultrasonically welding said top and bottom together.

19. The system of claim 18 further comprising:

a side of said bottom including a viewing section, said viewing section being transparent, wherein a side of said collectable article is observable through said viewing section.

20. The system of claim 19 wherein said collectable article is a comic book and a binding of said comic book is observable through said viewing section.

21. The system of claim 1 wherein said case further comprises:

at least one depression formed in an edge of said bottom and said top adapted for receiving a tool to break the seal between said top and said bottom.

22. The system of claim 1 wherein said collectable article is a comic book.

23. A method for authenticating a collectable article comprising:

sealing said collectable article in a core;

coupling a certificate to said core;

placing said core between a top and bottom of a case; and sealing said top and bottom by ultrasonic bonding, wherein said case includes means for positively indicating sealing of said top to said bottom.

24. The method of claim 23 wherein said means for positively indicating sealing of said top to said bottom comprises:

at least one protrusion extending from an inner surface of at least one corner of said top of said case, a post cavity formed within said protrusion; and a post extending from an inner surface of said bottom of said case, wherein said post is received in said post cavity before said top and bottom are sealed together and said post is welded to said post cavity during said ultrasonic bonding said top and bottom together.

25. The method of claim 24 wherein said sides of said top are formed of a first section which is semi-opaque and at least one corner section which is transparent positioned between said first section of adjacent sides and said post and said protrusion are formed of a transparent material, wherein said post welded to said cavity is observable through said corner section and a fracture in said post indicates a tamper condition.

26. The method of claim 24 further comprising:

a side of said bottom including a viewing section, said viewing section being transparent, wherein a side of said collectable article is observable through said viewing section.

27. The method of claim 26 wherein said collectable article is a comic book and a binding of said comic is observable through said viewing section.

28. The method of claim 23 wherein said collectable article is a comic book.

* * * * *